US008027481B2

(12) United States Patent
Beard

(10) Patent No.: US 8,027,481 B2
(45) Date of Patent: Sep. 27, 2011

(54) PERSONAL HEARING CONTROL SYSTEM AND METHOD

(76) Inventor: Terry Beard, Thousand Oaks, CA (US)

( * ) Notice: Subject to any disclaimer, the term of this patent is extended or adjusted under 35 U.S.C. 154(b) by 995 days.

(21) Appl. No.: 11/982,918

(22) Filed: Nov. 5, 2007

(65) Prior Publication Data

US 2008/0107287 A1 May 8, 2008

Related U.S. Application Data

(60) Provisional application No. 60/857,234, filed on Nov. 6, 2006.

(51) Int. Cl.
*H04R 25/00* (2006.01)

(52) U.S. Cl. ..... 381/60; 381/328

(58) Field of Classification Search ..... 381/23.1, 381/60, 328, 380

See application file for complete search history.

(56) References Cited

U.S. PATENT DOCUMENTS

| | | | | |
|---|---|---|---|---|
| 4,455,675 | A | 6/1984 | Bose et al. | 381/74 |
| 4,494,074 | A | 1/1985 | Bose | 330/109 |
| 4,677,677 | A | 6/1987 | Eriksson | 381/71 |
| 4,833,719 | A | 5/1989 | Carme et al. | 381/72 |
| 4,985,925 | A | 1/1991 | Langberg et al. | 381/72 |
| 5,091,954 | A | 2/1992 | Sasaki et al. | 381/72 |
| 5,138,664 | A | 8/1992 | Kimura et al. | 381/72 |
| 5,182,774 | A | 1/1993 | Bourk | 381/71 |
| 5,201,007 | A | 4/1993 | Ward et al. | 381/68.6 |
| 5,267,321 | A | 11/1993 | Langberg | 381/72 |
| 5,390,254 | A | 2/1995 | Adelman | 381/68 |
| 5,937,070 | A | 8/1999 | Todter et al. | 381/71.6 |
| 6,661,901 | B1 * | 12/2003 | Svean et al. | 381/328 |
| 6,920,227 | B2 | 7/2005 | Chalupper et al. | 381/312 |
| 7,072,476 | B2 | 7/2006 | White et al. | 381/74 |

* cited by examiner

*Primary Examiner* — Brian Ensey

(74) *Attorney, Agent, or Firm* — Koppel, Patrick, Heybl & Philpott

(57) ABSTRACT

A personal hearing control system includes a microphone located within a user's sealed ear canal, a speaker having a diaphragm which directs sound into the ear canal, and a controller which drives the speaker such that the system emulates the acoustics of the user's open ear canal. Also provided are a microphone located on the outer ear side of the sealed ear canal, which is coupled to a handheld interface unit having multiple inputs and operating modes. A user-selected input is processed by the interface unit, and the processed signal is coupled to the speaker. In one operating mode, the output of the outer ear mic is processed so as to cancel sound that leaks from the outer ear to the inner ear side of the seal.

42 Claims, 3 Drawing Sheets

FIG. 1
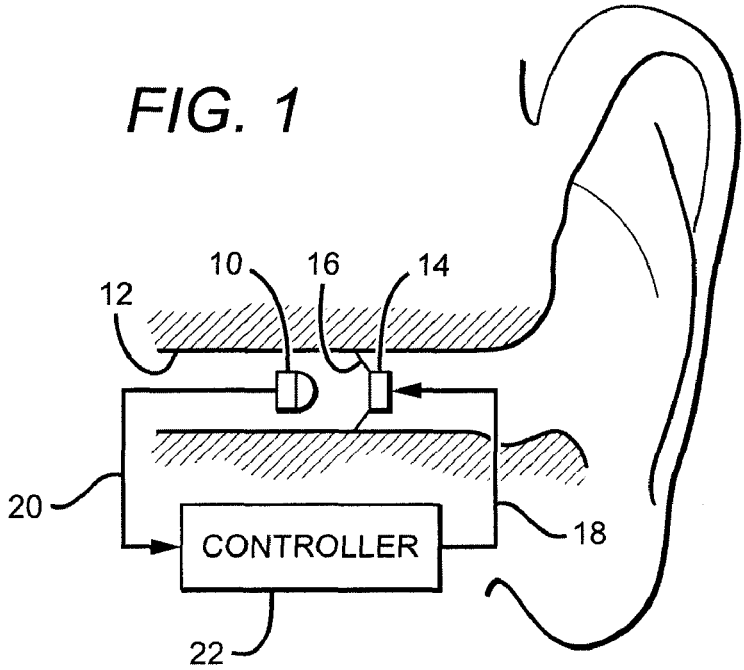
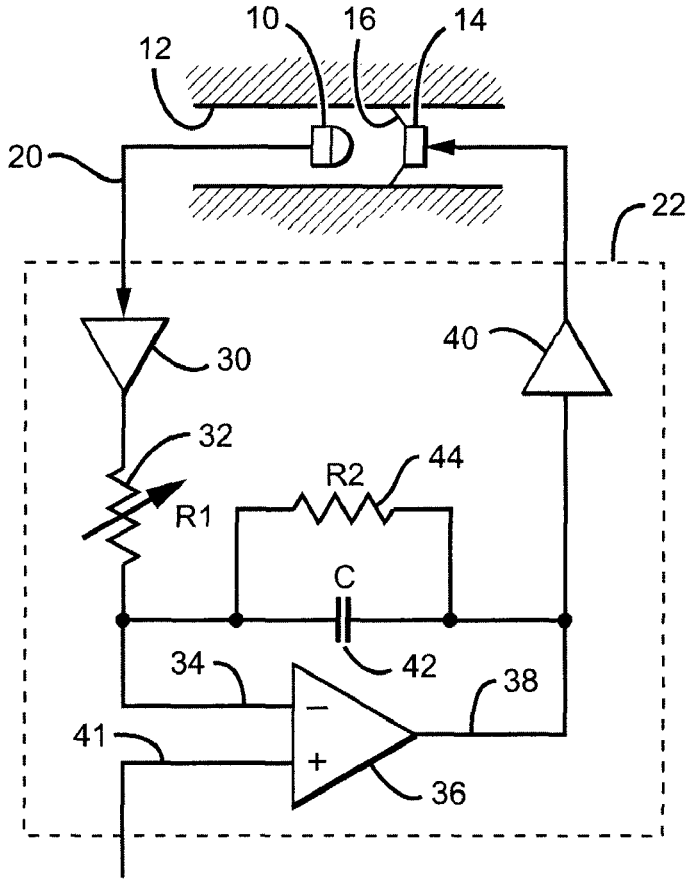
FIG. 2

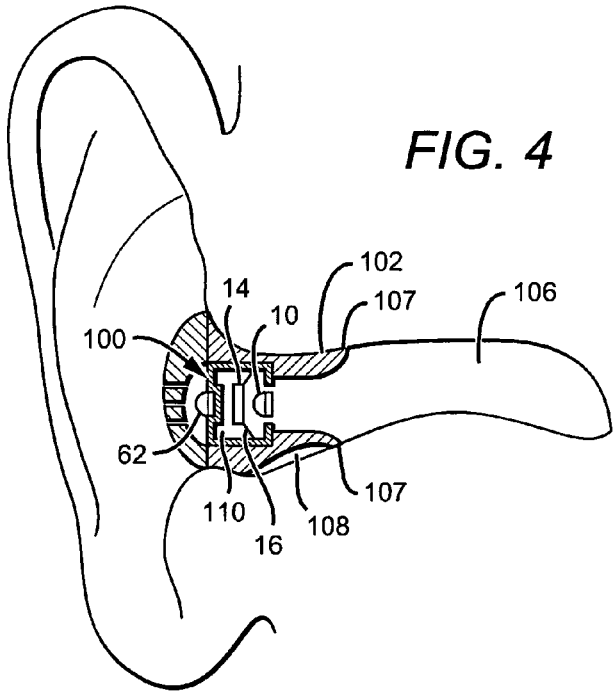
FIG. 4
FIG. 5
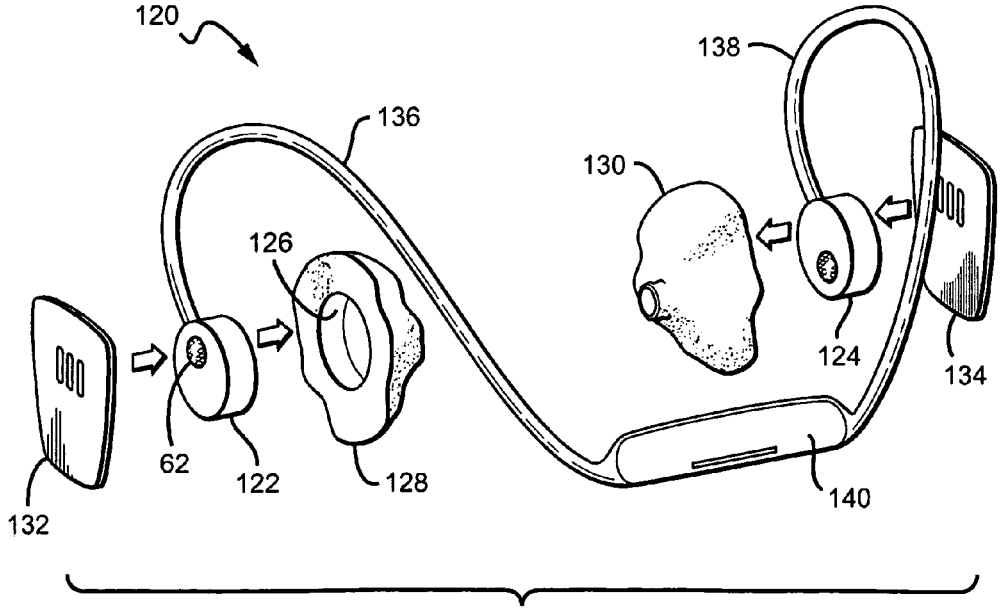

PERSONAL HEARING CONTROL SYSTEM AND METHOD

RELATED APPLICATIONS

This application claims the benefit of provisional patent application No. 60/857,234 to Beard, filed Nov. 6, 2006.

BACKGROUND OF THE INVENTION

1. Field of the Invention

This invention relates generally to earphone-type devices, and more particularly to a personal hearing system which affords a user complete control over what they hear.

2. Description of the Related Art

Various kinds of headphones and earphones are currently used as personal hearing devices. Each device has its applications and shortcomings.

Earphones are generally of two types: earphones which seal the ear canal, and "ear buds". An ear-sealing earphone is arranged to seal the ear canal when used, and thus must be removed for normal hearing of outside sound. Sealing the ear canal serves to effectively block outside sound and provide good audio fidelity, but is less comfortable and subjects the user to the "occlusion effect" because the ear canal is blocked. If a user's ear canal is sealed, vibrations caused by his voice and other body-conducted sounds are greatly accentuated; the effect is described as sounding like being inside a barrel.

Similarly, headphones which form a seal around the ear can deliver good audio fidelity, block outside sound and can be reasonably comfortable to wear, but are bulky and not suitable for everyday portable use.

The other earphone type—"ear buds"—fit loosely in the concha of the ear. They are comfortable, light and portable, but provide relatively poor audio fidelity. They do not block outside sound. This is both a strength and weakness of the design. By not sealing the entrance to the ear, the user does not experience the annoying occlusion effect caused by having a sealed ear canal. But by not sealing the ear canal, outside sound freely leaks into the user's ear, while reproduced sound leaks out, thereby compromising privacy. Furthermore, the low frequency response of an ear bud-type earphone tends to be poor.

Various methods have been tried to ameliorate the undesirable distortion caused by the occlusion effect. For example, some ear-sealing hearing aids provide small vents between the inside and outside of the ear canal. These vents help, but do not eliminate the effect. Deeply fitted hearing aids exhibit less of the effect, but are uncomfortable and difficult to insert.

SUMMARY OF THE INVENTION

A personal hearing control system and method are presented which overcome the problems noted above, by providing a means of overcoming the occlusion effect while still blocking outside sound and providing good audio fidelity.

The present system includes a microphone suitable for placement within a user's ear canal (the 'ear canal microphone') which produces an output signal that varies with the instantaneous pressure in the ear canal, a small loudspeaker which includes a diaphragm that directs sound into the ear canal, and a controller which receives the output signal from the ear canal microphone and provides a driving signal to the speaker. The controller is arranged to control the relationship between the instantaneous pressure in the ear canal and the speaker diaphragm's velocity such that the velocity is proportional to the instantaneous pressure over the range of sound frequencies that would otherwise be affected by the occlusion effect. When properly arranged, the system emulates the acoustics of the user's open ear canal, thereby reducing or eliminating the occlusion effect even when fitted to seal the ear canal.

In a preferred embodiment, the personal hearing control system is fitted to seal the user's ear canal, with the speaker and ear canal microphone located on the inner ear side of the seal. The system preferably also includes a microphone located on the outer ear side of the seal, and a handheld interface unit having one or more inputs suitable for connection to respective sources of audio including the outer ear microphone. The interface is arranged to produce an output that varies with the audio received at a selected one of its inputs, and to couple the output—preferably wirelessly—to the speaker.

The interface unit preferably has multiple selectable operating modes. For example, the interface could be arranged such that the output of the outer ear microphone is processed such that the signal coupled to the speaker cancels sound that leaks from the outer ear to the inner ear side of the seal. In another operating mode, the system provides accurate high fidelity reproduction by the speaker of sound received by the outer ear microphone.

When properly arranged, the present hearing control system provides the capability of environmental noise control, private communication, and a practical and effective platform technology for recording and playing back 3D audio, with the handheld interface unit controlling the mode of operation for various communication, entertainment and listening applications.

These and other features, aspects, and advantages of the present invention will become better understood with reference to the following drawings, description, and claims.

BRIEF DESCRIPTION OF THE DRAWINGS

FIG. 1 is a diagram of a control loop as used with the present personal hearing control system which enables the acoustics of a user's open ear canal to be emulated.

FIG. 2 is a schematic diagram of a controller as might be used in the loop of FIG. 1.

FIG. 4 is a side elevation view of one possible embodiment of the portion of the present system that is in contact with a user's ear.

FIG. 5 is a perspective view of one possible embodiment of a personal hearing control system in accordance with the present invention.

DETAILED DESCRIPTION OF THE INVENTION

Figure 3:
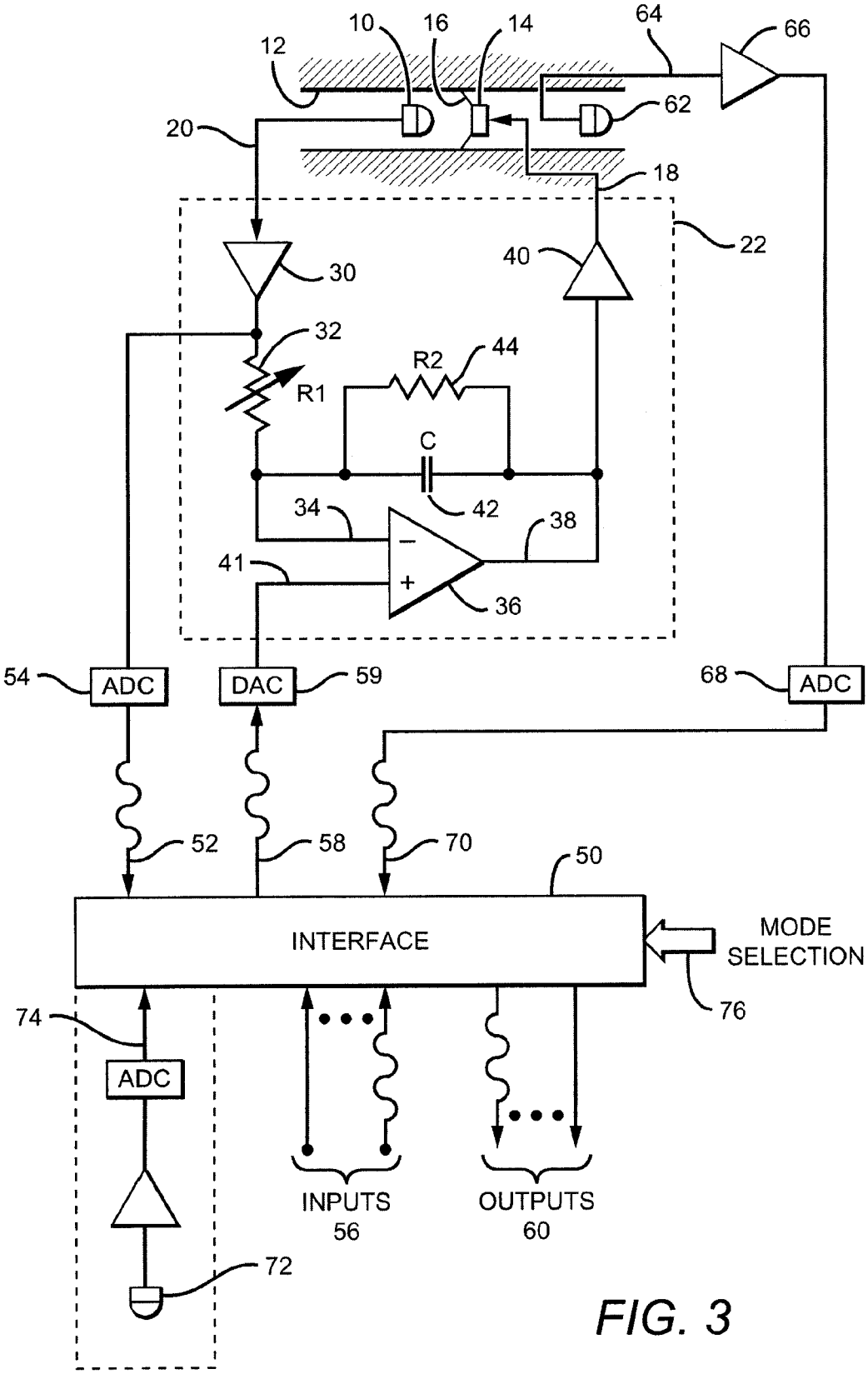
FIG. 3 is a block/schematic diagram illustrating one possible embodiment of a personal hearing control system in accordance with the present invention.

The present personal hearing control system employs a speaker, control electronics, and a microphone inside a user's ear canal to emulate the acoustic dynamics of the user's own unobstructed ear. The system can operate so as to appear acoustically transparent to the user so that it can be used for normal listening, while also providing environmental noise control, private communication, and a practical and effective platform technology for recording and playing back 3D audio. The system preferably includes a handheld interface unit which selects and controls the system's mode of operation for various communication, entertainment and listening applications, and provides the system with various wired and wireless input and output channels.

In a preferred embodiment, the system acoustically seals the ear canals and essentially blocks the passage of sound from outside. However, a sealed ear canal normally gives rise to the "occlusion effect" as described above, which is experienced by the user over a limited frequency range of incoming sound (<~2 kHz). The occlusion effect, which would ordinarily be unacceptable in this circumstance, is reduced or eliminated by the present system's active electronic emulation of open ear canal acoustics. Active control of the acoustic behavior inside the sealed ear canal is accomplished using a signal from a pressure-sensing microphone inside the canal, located proximate to the diaphragm of a sound-producing loudspeaker positioned to direct sound into the canal. The signal from the microphone is used to compute a signal which drives the speaker so as to control the relationship between the instantaneous pressure in the ear canal and the diaphragm's velocity such that the velocity is proportional to the instantaneous pressure over the range of sound frequencies that would otherwise be affected by the occlusion effect.

In a sound wave, the pressure and displacement of the air vary with time. The relationship of the pressure and displacement define the acoustic impedance of the medium through which the sound wave is propagating. When properly arranged, the system provides a control signal which drives the speaker diaphragm as needed to emulate the acoustics of the user's open ear canal, thereby reducing or eliminating the occlusion effect even when fitted to seal the user's ear canal.

Note that, though the present system could be beneficial to a user if employed on just one ear, a system which controls the sound delivered to both ears is preferred, and while the discussion below describes the components needed for a single ear, it is understood that a duplicate set of components would be needed to accommodate both ears.

Also note that the present system could be useful even if arranged such that the ear canals are not sealed when used. However, greater control over what a user hears is obtained when the system is arranged to seal the ear canals. For this reason, a system which seals both ear canals and controls the sound delivered to both ears is preferred, and is assumed throughout the discussion below.

The arrangement of components described above is symbolically illustrated in FIG. 1. An 'ear canal microphone' 10 is located within a user's ear canal 12, and a speaker 14 having a diaphragm 16 is arranged to direct sound into the user's ear canal in response to a driving signal 18. Ear canal microphone 10 produces an output signal 20 which varies with the instantaneous pressure in the ear canal. A controller 22 receives this signal and produces driving signal 18 so as to control the relationship between the instantaneous pressure in the ear canal and the speaker diaphragm's velocity such that the velocity is proportional to the instantaneous pressure. Thus, when the pressure measured by microphone 10 increases, a force is applied to speaker 14 causing the velocity of diaphragm 16 to increase to the right in FIG. 1. When the relationship between diaphragm velocity and instantaneous air pressure is properly established over the range of sound frequencies that would normally be affected by the occlusion effect, the system emulates the acoustics of the user's open ear canal, thereby reducing or eliminating the occlusion effect that would otherwise be experienced.

Achieving this performance places some strict requirements on microphone 10, speaker 14 and controller 22 to assure proper operation and stability. Ear canal microphone 10 is suitably an electrostatic or electret pressure microphone, which do an excellent job of measuring pressure at audio frequencies. These microphone types work well for the present application, provided they are operated below their mechanical resonant frequency.

Speaker 14 needs to have characteristics which allow it to act coherently and with minimal phase shift with respect to driving signal 18. The speaker also has an associated mechanical resonant frequency which is important in determining the stability of the system, since this is usually the first resonance encountered. For applied sinusoidal forces below the resonant frequency, the displacement of the diaphragm of a speaker is proportional to and in phase with the applied force.

Controller 22 is preferably implemented with analog circuitry; one possible implementation is shown schematically in FIG. 2. As noted above, it is understood that the circuitry indicated would typically be duplicated for both the left and right ears of the user. As above, ear canal microphone 10 measures the instantaneous pressure in the ear canal. The output 20 of the ear canal mic is preferably buffered with a buffer amplifier 30, the output of which is delivered to a resistor 32 having a resistance R1 to produce a current proportional to instantaneous pressure, which is delivered to the inverting input 34 of an operational amplifier 36. The output 38 of op amp 36 drives speaker 14, preferably through a driver amplifier 40. A capacitor 42 having a capacitance C is connected between output 38 and inverting input 34 of op amp 36. Additional signals can be coupled to speaker 14 via the op amp's non-inverting input 41; this is discussed in detail below.

In closed loop operation, the current through resistor 32 into the op amp's inverting input 34 must equal the current flowing out of node 34 through capacitor 42 to the op amp's output 38. The current flowing through capacitor 42 is proportional to the rate of change or first derivative of the output voltage of op amp 36; op amp 36 thus operates as an inverting integrator. If the displacement of speaker diaphragm 16 is proportional to the applied voltage, then it follows that the velocity of the diaphragm is proportional to the pressure measured by microphone 10.

If the value of resistor 32 is reduced or the gain of amplifier 30 increased, the current input to the inverting input of op amp 36 increases for a given increase in pressure detected by microphone 10. Thus, by changing the value of resistor 32 or the gain of amplifier 30 while keeping the capacitance of capacitor 42 constant, one can change the effective acoustic impedance in the ear canal. Resistor 32 can thus be adjusted to cause the speaker to match the acoustic impedance of an open ear canal. Resistor 32 is preferably made variable, such that it can be adjusted to the user's preference.

In FIG. 2, driver amplifier 40 is shown providing the power to drive speaker 14, and buffer amplifier 30 amplifies the output of microphone 10. The arrangement shown forms a negative feedback or servo control system, and therefore system stability is an issue. In considering the stability of the system, assume that the respective gains of amplifiers 30 and 40 are adjusted so that at low frequencies, a voltage change of 1 volt at the output of amplifier 36 causes a 1 volt change in the output of buffer amplifier 30. Resistor 32 and capacitor 42 determine a critical frequency CF equal to:

$$CF = \frac{1}{R1} * C * 2\pi$$

If the first mechanical resonance of the system, in particular the speaker (discussed above), is higher than this critical frequency, the system will be stable. Above CF, the system ceases to be a negative feedback servo system and instead acts as a follower; in this case, the output of amplifier 36 simply follows the voltage appearing on its non-inverting input 41 and the system is stable, even though the response of speaker 14 may be out of phase with the signal applied to it.

As a practical matter, the mechanical resonant frequency of the speaker should be greater than 2 kHz in order to achieve an acceptable simulated open ear acoustic impedance to minimize the occlusion effect. If the resistance of resistor 32 is reduced until CF is greater than the resonant frequency of the speaker, the system will become unstable and oscillate. Ideally, the system is designed so that the enclosed volume of air trapped on the back side of the speaker diaphragm acts as the primary spring acting against the mass of the diaphragm. This volume of air defines the spring constant and thereby the upper limit of the diaphragm's mass to achieve a resonant frequency above 2 kHz. An electrostatic speaker can be readily designed to meet this requirement. A conventional dynamic speaker can be made to meet the criteria by restricting the volume of the cavity on the back side of the diaphragm or stiffening the diaphragm support to achieve a sufficiently high spring constant. However, the higher the spring constant, the greater the force needed to achieve a fixed displacement and equivalent change of pressure in the sealed ear canal and the greater the power input required for a given sound level. Thus, the present system may be implemented using conventional dynamic ear phone speakers such as those used in ear bud earphones, provided each speaker's resonant frequency is shifted to the range required.

In a preferred embodiment, the speaker and back volume are designed to provide a mechanical resonance of about 4 kHz. Making the resistance R1 of resistor 32 equal to $10^5\Omega$ and the capacitance C of capacitor 42 equal to 1000 pf yields a CF of approximately 1.6 kHz, which is well below the speaker resonance of 4 kHz. The system is therefore stable. In this case, the value of R1 can be adjusted to less than half of its $10^5\Omega$ value and stability would still be maintained, since the resultant CF of 3.2 kHz would still be less than the 4 kHz resonance of the speaker. This range of adjustment provides for effective emulation of open ear acoustics.

Capacitor 42 is preferably bridged by a resistor 44 having a resistance R2. The purpose of this resistor is to provide bias current to the inverting input 34 of op amp 36 to provide DC stability. The RC time constant of resistor 44 and capacitor 42 (i.e., R2*C) should be at or below the lowest audio frequency of interest ($F_{min}$), such as 20 Hz. For example, setting C=1000 pf and R2=10 MΩ provides DC stability and a time constant of less than 20 Hz. These impedances are compatible with any of a large number of low noise high input impedance operational amplifiers available from a number of suppliers.

For frequencies above the CF determined by the RC time constant of resistor 32 and capacitor 42, the feedback through capacitor 42 dominates the feedback through resistor 32, and op amp 36 effectively acts as a voltage follower—such that the output 38 of op amp 36 follows the voltage applied at the op amp's non-inverting input 41.

At frequencies below CF, distortion of the audio produced by speaker 14 is reduced due to the negative feedback provided by op amp 36. In this frequency range, the pressure as measured by ear canal microphone 10 accurately follows the signal applied to the non-inverting input 41 of op amp 36.

The preferred embodiment of the present personal hearing control system includes an interface unit having one or more inputs suitable for connection to respective sources of audio, which is arranged to process the audio received at a selected input and to couple the processed output to the speaker. The interface unit preferably has selectable operating modes which establish the characteristics of the processed output. An exemplary embodiment of a personal hearing control system which includes such an interface unit 50 is shown in FIG. 3. As noted above, the interface is arranged to receive and process one or more audio inputs, preferably in the digital domain, and provide an output which is coupled to speaker 14. For example, the output of ear canal microphone buffer amplifier 30 could be provided to an interface input 52, preferably after being converted to a digital signal using an analog-to-digital converter (ADC) 54. Inputs 56 might also be provided, for connection to audio sources such as a cell phone, telephone, MP3 player, radio, TV, computer, video game system, closed-circuit theater sound system, etc. An output 58 is preferably coupled to speaker 14 via a digital-to-analog converter (DAC) 59, the analog output of which is fed to the non-inverting input of op amp 36; additional outputs 60 are provided as needed. Some of the interface unit's inputs and outputs are preferably wireless connections, which are depicted as wavy lines in FIG. 3.

In a preferred embodiment, the personal hearing control system also includes a microphone 62 suitable for placement on the outer ear side of the ear canal. The output 64 of this microphone is preferably buffered with an amplifier 66, digitized with an ADC 68, and provided to an input 70 of interface unit 50. Microphone 62 is preferably a high quality, low noise microphone which picks up outside sound at the ear. Interface unit 50 might also include a built-in microphone 72 which allows the user to speak closely into it, for privacy or when in a noisy environment, the output of which is buffered, digitized and provided to another of the interface's inputs 74.

Interface unit 50 preferably includes multiple operating modes, with a means 76 provided with which a desired mode can be selected. The selected operating mode dictates which input signal is selected and how the selected signal is processed before being coupled to speaker 14. A selected input can be equalized, compressed, limited or otherwise modified in accordance with the selected operating mode.

Interface unit 50 can also include a digital audio memory for storing on board audio information like music. The interface can include digital processing power that allows actively modifying, storing, and sending digital audio information in various forms. With these features, the present system can operate in a wide range of modes selectable by the user. For instance, assuming the ear canal is substantially sealed by the system, if interface unit 50 sends no data via output 58 to DAC 59, the user will experience silence. That is, the components mounted in the ear will effectively block outside sound, controller 22 will emulate the acoustics of the user's open ear canal, and the zero input applied at non-inverting input 41 will further attenuate any outside sound leaking into the ear below the critical frequency.

Further attenuation of outside sound can be achieved by using the signal from outer ear microphone 62 to produce a signal which cancels the audio leaking into the sealed ear canal. This is accomplished by providing one or more filters within interface 50 which process the audio signal produced by outer ear microphone 62 such that a signal is coupled to speaker 14 that cancels sound that leaks from the outer ear to the inner ear side of the seal. Such a filter is preferably implemented by first determining the system transfer function between the audio signal produced by outer ear microphone 62 and the output of ear canal microphone 10, and the system transfer function between speaker 14 and the output of ear canal microphone 10. Once known, one or more filters can be implemented based on the transfer functions, which allow for the accurate cancellation of outside sound leaking into the sealed ear canal, as well as accurate high fidelity reproduction by the speaker of sound received by the outer ear microphone.

The filters can be, for example, feedforward finite impulse response (FIR) digital filters, with each filter's coefficients calculated based on the system transfer functions.

In practice, chirps, pseudorandom noise or swept sound signals can be used to determine the impulse transfer functions of the system. A feedforward noise cancellation scheme of this sort works effectively at lower frequencies, and since it is a feed forward system, there are no stability issues. Schemes of this type are typically implemented using one or more digital signal processors (DSPs). Methods for implementing filters based on system transfer functions as described herein are well known in the art.

The ability to cancel sound that leaks from the outer ear to the inner ear side of the seal is preferably provided as one of the interface unit's operating modes. For example, if a user wishes to make a phone call in a noisy environment, he could elect to activate the noise cancellation functionality described above, and thereby enhance his ability to clearly hear the other party.

The system is preferably arranged so that the filtering discussed above is adaptive. One way in which this may be achieved is to provide a means of automatically determining the system transfer functions and recalculating the filter coefficients, so that audio leaking into the sealed ear canal can be effectively cancelled under a variety of environmental conditions. Resetting of the filter coefficients in this way might be done continuously, on a periodic basis, or initiated by the user, via a pushbutton, for example. Adaptive filtering techniques of this sort are well-known to those familiar with digital filter design.

The present system provides the user with complete control of his audio input, and not only does not interfere with normal hearing, but can actually enhance it. Furthermore, it can provide hearing protection by limiting the level of sound delivered: for example, interface unit 50 can include a multiband limiter compressor which can be set to protect the user's hearing and even correct for hearing deficits in the manner of a hearing aid, if desired. The system also affords a user privacy, in that only the user can hear what he is listening to.

Built-in microphone 72 can be used to provide additional privacy. For example, if the system is used to make a phone call, the user could speak directly into built-in microphone 72. Alternatively, outside microphone 62 could be used to pick up the user's voice during phone calls.

Interface unit 50 can include an input suitable for connection to an external cell phone, or the interface unit may itself incorporate the circuitry needed to provide the functionality of a cell phone so that no external device is necessary. Similarly, interface unit 50 might incorporate the circuitry needed to provide the functionality of an MP3 player or other audio devices, so that external counterparts for these devices are not needed.

Interface unit 50 might also include a frequency equalizer, typically implemented with one or more digital filters, adjusted such that sound picked up by outer ear microphone 62 is coupled to speaker 14 such that it is reproduced for the user with desired frequency characteristics. Once the transfer function between the audio signal produced by outer ear microphone 62 and the output of ear canal microphone 10 has been ascertained, it can be used to accurately frequency equalize the system for a particular user, using a simple digital frequency equalizer which operates on the signal from microphone 62 before it is applied to the non-inverting input of op amp 36.

A personal hearing control system in accordance with the present invention can allow the user to have normal hearing without removing the earphones. The audio received from outer ear microphone 62 may be equalized and the occlusion effect reduced or eliminated as described above, with the result that outside sound is heard by the user as though the earphones are not there. This enables the system to act as a standard platform for 3D audio, as it provides for the standardization of the spatial audio signal characteristics received from outside ear microphone 62. In a preferred embodiment, the entire concha of the user's ear is filled such that the ear canal is substantially sealed, and outside microphone 62 is mounted flush on the outer surface of the system's earphone element so that the particular user's pinna and ear canal transfer function features are not present in the measured audio. In a 'normal' hearing (transparent) mode, the user's hearing system adapts to the audio heard exclusively by outside microphone 62, because all other sound leakage is suppressed below the level of audibility. The audio spatial characteristics of the signal from microphone 62 are associated by the user's internal auditory perception system with head turn and visual inputs so that the 3D audio cue set present in the audio signal from microphone 62 are adopted as the internally consistent set of 3D audio cues. The outside microphones are preferably mounted outside the filled concha with a standard baffle, so that they are acoustically consistent from user to user and are independent of individual pinna and ear canal acoustic characteristics that vary dramatically from individual to individual and create highly individualized head related transfer functions (HRTF's). The result is that the present system provides a universal platform to record and deliver standardized 3D audio signals that can be recorded and listened to by anyone.

The present personal hearing control system is preferably fitted and calibrated for an individual user. In the preferred embodiment of the earphone element of the system, molds of the user's ears are made using the same technique used for fitting hearing aids. A soft silicon rubber casting of the user's ear canal, including the entire concha of the external pinna of the ear is made. This casting is then used to make a negative mold which is an accurate replica of the user's ear and ear canal. A soft molding compound such as Locktite Resonaid type 3596 is used to make a soft, snug-fitting ear mold with a cavity into which an electroacoustic unit containing speaker 14, ear canal microphone 10, and outer ear microphone 62, is mounted. The system components which directly interface with the components in the electroacoustic unit are preferably contained in a separate electronics unit (element 140 in FIG. 5, discussed below) located in a headband behind the head that also provides light medial pressure to the ear molds holding them in place. Due to their size and power requirements, the system's digital signal processing electronics are preferably housed within interface unit 50, rather than in the headband portion of the system.

It is desirable that the ear mold element of the earphone effectively seal the ear canal, which serves to prevent higher frequency sounds from reaching the inner ear. However, a very small pressure equalization vent should be provided to equalize the pressure between the sealed ear canal and the outside world, while substantially attenuating audio frequencies above $F_{min}$. The back volume of the earphone unit which contains the microphones and speaker and acts as the back spring on the speaker diaphragm must also be vented to the outside world by a similar very small vent to provide pressure equalization.

FIG. 4 is a cut-away drawing showing a preferred configuration for the ear-mounted elements of a system as described herein. Ear canal mic 10, outer ear mic 62 and speaker 14 of the earphone element are contained in a shell 100. The shell is mounted inside a custom ear mold 102 which fits snugly in the concha of the ear. Ear mold 102 extends into ear canal 106 and seals at 107. This seal blocks leakage of outside sound and provides for good low frequency response of the system. Seal 107 is preferably designed to leave an area 108 open to the atmosphere, to provide a relief path for pressure that might otherwise build due to mandible vibrations. The back seal volume 110 is preferably standardized, and is the determining contributor to the spring constant experienced by the diaphragm 16 of speaker 14. In practice, this volume should be less than 2 cubic centimeters. The molded earpiece can be designed to be held in place by the external ear itself, or can be held in place by a slight inward pressure by the headband or a spectacle configuration which combines the hearing devices with glasses.

It is desirable that the ear mold 102 mount firmly against the temporal bone portion of the concha of the ear, and to fit loosely against and preferably not touch that portion of the concha and initial portion of the ear canal which moves with chewing, so that the seal does not move with talking or chewing. Personal fitting of the ear mold is desirable even though the adaptive and servo characteristics of the system can provide relief from some variations inherent in a standard fitted implementation.

It is desired to have a stable ear seal in position for the most accurate stable personal audio calibration possible. Once fitted to the user, the system transfer functions are stable and can be measured and used to set up the filtering and frequency equalization described above. The calibration signal used to determine the system's transfer functions can be a sweep tone, but a chirp method or impulse method may also be used. In a typical set up procedure, the resistor 32 which sets the effective canal impedance is first set to provide a user-determined open ear characteristic. This is a subjective quality which only the user can determine. With resistor 32 set and the transfer functions known, any desired frequency response characteristic can be provided by digital filters in interface unit 50.

It is desirable that the ear canal and outer ear microphones be matched and of high quality and provide high signal to noise ratios. DPA type 4060 miniature electret microphones are suitable for the application. These microphones provide a typical noise floor of 23 DBA and can be matched. To provide acceptable 3D audio performance, it is important that the acoustic characteristics of outer ear microphone 62 and its baffle match a standard reference, so that audio recorded by other individuals or a standard dummy mount closely match the sound that would be detected by the user's own microphones in the same circumstance.

The digital frequency equalization provided by interface unit 50 can be set to mimic the individual user's open ear levels, by matching frequency dependent thresholds with the personal hearing system in place, and with the personal hearing system removed. However, compensation to a standard frequency response as measured by ear canal microphone 10 has been found to be acceptable and even desirable in most cases since the user rapidly adapts to this equalization.

FIG. 5 depicts one possible embodiment of a headband 120, which includes the system's earphone components and electronics which are not contained within interface unit 50. An electroacoustic module 122 holds outer ear microphone 62 and ear canal microphone 10 (not shown), and speaker 12 (not shown) for the left ear. A similar module 124 is shown for the right ear. Electroacoustic module 122 fits into a mating cavity 126 in the left ear custom-cast ear mold 128. Module 124 fits into a mating cavity in the right ear custom-cast ear mold 130. Decorative baffles 132 and 134 are mounted on the outside of electroacoustic modules 122 and 124; these baffles refine the acoustic character of the modules. The electroacoustic modules are typically cylinders 10-15 millimeters in diameter and 8-10 millimeters high. Headband ear shafts 136 and 138 connect electroacoustic modules 122 and 124 to a behind-the-head electronics module 140, which preferably contains the electronics of the earphone unit—such as op amp 36, buffer amps 30 and 66, driving amp 40, resistors 32 and 44, capacitor 42, ADCs 54 and 68 and DAC 59, as well as circuitry required to implement wireless communication with interface unit 50 as needed—and a rechargeable battery power supply. Ear shafts 136 and 138 are flexible, such that they can be flexed to allow putting the earphones on the user, and flex back to provide inward pressure on the electroacoustic modules helping to hold them and the ear molds in place in the user's ears. Ear molds 128 and 130 may be first inserted into the user's ears, and the headband unit then fitted over the ears and the electroacoustic modules pressed into their mating cavities 126 in the ear molds. The headband units can be manufactured in a range of sizes to comfortably fit users with different size heads and ear placements just as shoes are manufactured in a range of sizes; these headband units would then fit into custom-made ear molds. Electroacoustic modules 122 and 124 and electronics module 140 can be considered standard units amenable to mass production.

Interface unit 50 is preferably arranged to allow the user to select any one of multiple inputs from the set of inputs, and if desired to compress, limit and equalize those signals delivered by the system to the ears. Thus the present personal hearing control system gives the user complete control over his audio inputs and outputs, suitable for all circumstances of communication, 3D audio entertainment, and normal everyday life.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

I claim:

1. A personal hearing control system, comprising:

an ear canal microphone suitable for placement within a user's ear canal;

a speaker suitable for placement between said ear canal microphone and said user's outer ear, said speaker including a diaphragm which directs sound into said user's ear canal in response to a driving signal, said ear canal microphone arranged to produce an output signal which varies with the instantaneous pressure in said ear canal; and a controller which receives the output signal from said ear canal microphone and provides said driving signal to said speaker, said controller forming a closed loop feedback system with said ear canal microphone and speaker which operates to control the relationship between the instantaneous pressure in said ear canal and said diaphragm's velocity such that said velocity is proportional to said instantaneous pressure over the range of sound frequencies that would normally be affected by the occlusion effect and thereby reduce or eliminate the occlusion effect that would otherwise be experienced by said user.

2. The system of claim 1, wherein said controller is arranged such that said system emulates the acoustics of said user's open ear canal.

3. A personal hearing control system, comprising:

an ear canal microphone suitable for placement within a user's ear canal;

a speaker suitable for placement between said ear canal microphone and said user's outer ear, said speaker including a diaphragm which directs sound into said user's ear canal in response to a driving signal, said ear canal microphone arranged to produce an output signal which varies with the instantaneous pressure in said ear canal; and a controller which receives the output signal from said ear canal microphone and provides said driving signal to said speaker, said controller arranged to control the relationship between the instantaneous pressure in said ear canal and said diaphragm's velocity such that said velocity is proportional to said instantaneous pressure over the range of sound frequencies that would normally be affected by the occlusion effect;

wherein said controller comprises an amplifier circuit arranged to operate as an inverting integrator, said amplifier circuit comprising:

an operational amplifier; and a capacitor connected between the output of said operational amplifier and its inverting input, said inverting input coupled to a signal which varies with the output signal from said ear canal microphone, said amplifier circuit arranged such that said driving signal used to drive said speaker's diaphragm varies with said operational amplifier output.

4. The system of claim 3, wherein said amplifier circuit further comprises a resistor connected in series between said signal that varies with the output signal from said ear canal microphone and said inverting input, said ear canal microphone, said controller and said speaker forming a closed loop feedback system arranged such that the current flowing through said resistor into the node at said inverting input is equal to the current flowing from said node through said capacitor to said operational amplifier output, such that the effective acoustic impedance of said diaphragm varies with the resistance of said resistor.

5. The system of claim 4, wherein said speaker has an associated mechanical resonance frequency, said speaker arranged such that said mechanical resonance frequency is greater than a critical frequency CF given by:

$$CF = \frac{1}{R1} * C * 2\pi,$$

where R and C are the resistance and capacitance of said resistance and capacitor, respectively.

6. The system of claim 3, further comprising a resistor connected in parallel with said capacitor, said system having an associated minimum audio frequency of interest ($F_{min}$), the resistance R of said resistor and the capacitance C of said capacitor selected such that $F_{min} \geqq RC$.

7. The system of claim 1, further comprising:

a sealing means which substantially seals a user's ear canal when worn; and a vent through said sealing means which equalizes the air pressure between the inner ear and outer ear sides of said sealing means, said ear canal microphone and said speaker positioned on the inner ear side of said seal.

8. A personal hearing control system, comprising:

an ear canal microphone suitable for placement within a user's ear canal;

a speaker suitable for placement between said ear canal microphone and said user's outer ear, said speaker including a diaphragm which directs sound into said user's ear canal in response to a driving signal, said ear canal microphone arranged to produce an output signal which varies with the instantaneous pressure in said ear canal;

a controller which receives the output signal from said ear canal microphone and provides said driving signal to said speaker, said controller arranged to control the relationship between the instantaneous pressure in said ear canal and said diaphragm's velocity such that said velocity is proportional to said instantaneous pressure over the range of sound frequencies that would normally be affected by the occlusion effect;

a sealing means which substantially seals a user's ear canal when worn; and a vent through said sealing means which equalizes the air pressure between the inner ear and outer ear sides of said sealing means, said ear canal microphone and said speaker positioned on the inner ear side of said seal;

wherein said system has an associated minimum audio frequency of interest ($F_{min}$) and said vent is arranged to substantially attenuate audio frequencies above $F_{min}$.

9. The system of claim 1, further comprising an interface unit having one or more inputs suitable for connection to respective sources of audio, said interface unit arranged to produce an output that varies with the audio received at a user-selected input and to couple said output to said speaker.

10. The system of claim 9, wherein said interface unit is arranged such that said output is coupled to said speaker wirelessly.

11. The system of claim 9, further comprising an outer ear microphone suitable for placement on the outer ear side of said speaker, the output of said outer ear microphone coupled to an input of said interface unit, said interface unit arranged to process the output of said outer ear microphone and couple said processed output to said speaker.

12. The system of claim 11, wherein said interface unit has multiple selectable operating modes, said interface unit arranged such that the characteristics of said processed output vary with said operating modes.

13. A personal hearing control system, comprising:

an ear canal microphone suitable for placement within a user's ear canal;

a speaker suitable for placement between said ear canal microphone and said user's outer ear, said speaker including a diaphragm which directs sound into said user's ear canal in response to a driving signal, said ear canal microphone arranged to produce an output signal which varies with the instantaneous pressure in said ear canal;

a controller which receives the output signal from said ear canal microphone and provides said driving signal to said speaker, said controller arranged to control the relationship between the instantaneous pressure in said ear canal and said diaphragm's velocity such that said velocity is proportional to said instantaneous pressure over the range of sound frequencies that would normally be affected by the occlusion effect;

an interface unit having one or more inputs suitable for connection to respective sources of audio, said interface unit arranged to produce an output that varies with the audio received at a user-selected input and to couple said output to said speaker; and an outer ear microphone suitable for placement on the outer ear side of said speaker, the output of said outer ear microphone coupled to an input of said interface unit, said interface unit arranged to process the output of said outer ear microphone and couple said processed output to said speaker;

wherein said interface unit has multiple selectable operating modes, said interface unit arranged such that the characteristics of said processed output vary with said operating modes; and wherein said system is arranged to substantially seal a user's ear canal when worn such that said ear canal microphone and said speaker are on the inner ear side of said seal and said outer ear microphone is on the outer ear side of said seal, said interface unit arranged such that in a first operating mode, said interface unit is arranged to process the output of said outer ear microphone such that a signal is coupled to said speaker which cancels sound that leaks from the outer ear side of said seal to the inner ear side of said seal, and in a second operating mode, said interface unit is arranged to process the output of said outer ear microphone such that sound picked up by said outer ear microphone is coupled to said speaker such that it is reproduced for said user.

14. The system of claim 13, wherein said interface unit includes at least one finite impulse response (FIR) filter arranged to effect said sound leakage cancellation.

15. A personal hearing control system, comprising:

an ear canal microphone suitable for placement within a user's ear canal;

a speaker suitable for placement between said ear canal microphone and said user's outer ear, said speaker including a diaphragm which directs sound into said user's ear canal in response to a driving signal, said ear canal microphone arranged to produce an output signal which varies with the instantaneous pressure in said ear canal;

a controller which receives the output signal from said ear canal microphone and provides said driving signal to said speaker, said controller arranged to control the relationship between the instantaneous pressure in said ear canal and said diaphragm's velocity such that said velocity is proportional to said instantaneous pressure over the range of sound frequencies that would normally be affected by the occlusion effect;

an interface unit having one or more inputs suitable for connection to respective sources of audio, said interface unit arranged to produce an output that varies with the audio received at a user-selected input and to couple said output to said speaker; and an outer ear microphone suitable for placement on the outer ear side of said speaker, the output of said outer ear microphone coupled to an input of said interface unit, said interface unit arranged to process the output of said outer ear microphone and couple said processed output to said speaker;

wherein said system includes a mold arranged to fill the entire concha of said user's ear such that said user's ear canal is substantially sealed, said system arranged such that said outer ear microphone is mounted flush on the outer surface of said mold such that the effect of said user's pinna and ear canal response transfer function on the audio performance of said system is negligible.

16. The system of claim 15, wherein said system is arranged such that the occlusion effect that would otherwise be experienced by said user is substantially reduced and a signal is coupled to said speaker which cancels sound that leaks from the outer ear side of said seal to the inner ear side of said seal, thereby enabling 3D audio cues present in the audio signal produced by said outer ear microphone to be adopted by said user as an internally consistent set of 3D audio cues and said system to act as a standard platform for 3D audio.

17. A personal hearing control system, comprising:

an ear canal microphone suitable for placement within a user's ear canal;

a speaker suitable for placement between said ear canal microphone and said user's outer ear, said speaker including a diaphragm which directs sound into said user's ear canal in response to a driving signal, said ear canal microphone arranged to produce an output signal which varies with the instantaneous pressure in said ear canal;

a controller which receives the output signal from said ear canal microphone and provides said driving signal to said speaker, said controller arranged to control the relationship between the instantaneous pressure in said ear canal and said diaphragm's velocity such that said velocity is proportional to said instantaneous pressure over the range of sound frequencies that would normally be affected by the occlusion effect;

an interface unit having one or more inputs suitable for connection to respective sources of audio, said interface unit arranged to produce an output that varies with the audio received at a user-selected input and to couple said output to said speaker; and an outer ear microphone suitable for placement on the outer ear side of said speaker, the output of said outer ear microphone coupled to an input of said interface unit, said interface unit arranged to process the output of said outer ear microphone and couple said processed output to said speaker;

wherein said interface unit includes a frequency equalizer adjusted such that sound picked up by said outer ear microphone is coupled to said speaker such that it is reproduced for said user with desired frequency characteristics.

18. A personal hearing control system, comprising:

an ear canal microphone suitable for placement within a user's ear canal;

a speaker suitable for placement between said ear canal microphone and said user's outer ear, said speaker including a diaphragm which directs sound into said user's ear canal in response to a driving signal, said ear canal microphone arranged to produce an output signal which varies with the instantaneous pressure in said ear canal; and a controller which receives the output signal from said ear canal microphone and provides said driving signal to said speaker, said controller arranged to control the relationship between the instantaneous pressure in said ear canal and said diaphragm's velocity such that said velocity is proportional to said instantaneous pressure over the range of sound frequencies that would normally be affected by the occlusion effect;

wherein said system comprises first and second ear canal microphones, speakers, and controllers, for use by said user in respective ears.

19. A personal hearing control system, comprising:

a sealing means which substantially seals a user's ear canal when worn, said sealing means including a vent which equalizes the air pressure between the inner ear and outer ear sides of said sealing means;

a ear canal microphone suitable for placement within a user's ear canal on the inner ear side of said sealing means;

a speaker suitable for placement within said user's ear canal on the inner ear side of said sealing means, said speaker including a diaphragm which directs sound into said user's ear canal in response to a driving signal, said ear canal microphone arranged to produce an output signal which varies with the instantaneous pressure in said ear canal;

a controller which receives the output signal from said ear canal microphone and provides said driving signal to said speaker, said controller arranged to control the relationship between the instantaneous pressure in said ear canal and said diaphragm's velocity such that said velocity is proportional to said instantaneous pressure over the range of sound frequencies that would normally be affected by the occlusion effect in said sealed ear canal, such that the occlusion effect is substantially reduced;

an interface unit having one or more inputs suitable for connection to respective sources of audio, said interface unit arranged to produce an output that varies with the audio received at a user-selected input and to couple said output to said speaker; and an outer ear microphone suitable for placement on the outer ear side of said sealing means, the output of said outer ear microphone coupled to an input of said interface unit, said interface unit arranged to process the output of said outer ear microphone and couple said processed output to said speaker, wherein said interface unit has multiple selectable operating modes, said interface unit arranged such that in a first operating mode, the output of said outer ear microphone is processed such that the output coupled to said speaker cancels sound that leaks from the outer ear side of said seal to the inner ear side of said seal, and in a second operating mode, the output of said outer ear microphone is processed such that sound picked up by said outer ear microphone is coupled to said speaker such that it is reproduced for said user.

20. A method of controlling the sound perceived by a user, comprising:

providing a means of substantially sealing a user's ear canal;

providing a speaker on the inner ear side of said sealing means having a diaphragm suitable for directing sound into said user's ear canal in response to a driving signal;

measuring the instantaneous pressure in said ear canal;

providing closed loop control of the relationship between the instantaneous pressure in said ear canal and said diaphragm's velocity such that said velocity is proportional to said instantaneous pressure over the range of sound frequencies that would normally be affected by the occlusion effect, such that the occlusion effect is substantially reduced, thereby enabling the acoustics of said user's open ear canal to be emulated;

providing an outer ear microphone suitable for placement on the outer ear side of said sealing means;

providing a means for receiving audio signals from one or more sources including said outer ear microphone; and providing said driving signal such that it varies with one of said received audio signals.

21. A method of controlling the sound perceived by a user, comprising:

providing a means of substantially sealing a user's ear canal;

providing a speaker on the inner ear side of said sealing means having a diaphragm suitable for directing sound into said user's ear canal in response to a driving signal;

measuring the instantaneous pressure in said ear canal using an ear canal microphone suitable for placement within a user's ear canal;

controlling the relationship between the instantaneous pressure in said ear canal and said diaphragm's velocity such that said velocity is proportional to said instantaneous pressure over the range of sound frequencies that would normally be affected by the occlusion effect, such that the occlusion effect is substantially reduced, thereby enabling the acoustics of said user's open ear canal to be emulated;

providing an outer ear microphone suitable for placement on the outer ear side of said sealing means;

providing a means for receiving audio signals from one or more sources including said outer ear microphone;

providing said driving signal such that it varies with one of said received audio signals;

determining the system transfer function between the audio signal produced by said outer ear microphone and the output of said ear canal microphone;

determining the system transfer function between said speaker and the output of said ear canal microphone;

implementing at least one filter based on said system transfer functions; and using said at least one filter to process the audio signal produced by said outer ear microphone such that a signal is coupled to said speaker which cancels sound that leaks from the outer ear side of said seal to the inner ear side of said seal.

22. The method of claim 21, wherein said at least one filter is at least one finite impulse response (FIR) filter, further comprising calculating the coefficients of said at least one finite impulse response (FIR) filter based on said system transfer functions.

23. The method of claim 22, further comprising providing a means of automatically determining said system transfer functions and recalculating said coefficients.

24. The method of claim 21, further comprising:

implementing at least one additional filter based on said system transfer functions; and using said at least one additional filter to process the audio signal produced by said outer ear microphone such that sound picked up by said outer ear microphone is coupled to said speaker such that it is reproduced for the user with desired frequency characteristics.

25. A method of controlling the sound perceived by a user, comprising:

providing a means of substantially sealing a user's ear canal;

providing a speaker on the inner ear side of said sealing means having a diaphragm suitable for directing sound into said user's ear canal in response to a driving signal;

measuring the instantaneous pressure in said ear canal;

controlling the relationship between the instantaneous pressure in said ear canal and said diaphragm's velocity such that said velocity is proportional to said instantaneous pressure over the range of sound frequencies that would normally be affected by the occlusion effect, such that the occlusion effect is substantially reduced, thereby enabling the acoustics of said user's open ear canal to be emulated;

providing an outer ear microphone suitable for placement on the outer ear side of said sealing means;

providing a means for receiving audio signals from one or more sources including said outer ear microphone;

providing said driving signal such that it varies with one of said received audio signals; and processing the audio signal produced by said outer ear microphone such that sound picked up by said outer ear microphone is reproduced for said user, and a signal is coupled to said speaker which cancels sound that leaks from the outer ear side of said seal to the inner ear side of said seal, thereby enabling 3D audio cues present in the audio signal produced by said outer ear microphone to be adopted by a user as an internally consistent set of 3D audio cues.

26. A personal hearing control system, comprising:

an ear canal microphone suitable for placement within a user's ear canal;

a speaker suitable for placement between said ear canal microphone and said user's outer ear, said speaker including a diaphragm which directs sound into said user's ear canal in response to a driving signal;

a controller which receives the output signal from said ear canal microphone and provides said driving signal to said speaker, said controller forming a closed loop feedback system with said ear canal microphone and speaker which operates to reduce or eliminate the occlusion effect that would otherwise be experienced by said user; and an interface unit having one or more inputs suitable for connection to respective sources of audio, said interface unit arranged to process the audio received at a user-selected input and to couple said processed audio to said speaker such that the audio received at said user-selected input is reproduced for said user.

27. A personal hearing control system, comprising:

an ear canal microphone suitable for placement within a user's ear canal;

a speaker suitable for placement between said ear canal microphone and said user's outer ear, said speaker including a diaphragm which directs sound into said user's ear canal in response to a driving signal;

a controller which receives the output signal from said ear canal microphone and provides said driving signal to said speaker; and an interface unit having one or more inputs suitable for connection to respective sources of audio, said interface unit arranged to process the audio received at a user-selected input and to couple said processed audio to said speaker such that the audio received at said user-selected input is reproduced for said user;

wherein said processed audio output by said interface unit output is coupled to said speaker via said controller.

28. The system of claim 26, further comprising an outer ear microphone suitable for placement on the outer ear side of said speaker, the output of said outer ear microphone coupled to an input of said interface unit, said interface unit arranged to process the output of said outer ear microphone and couple said processed output to said speaker.

29. The system of claim 26, wherein said interface unit has multiple selectable operating modes, said interface unit arranged such that the characteristics of said processed audio vary with said operating modes.

30. A personal hearing control system, comprising:

an ear canal microphone suitable for placement within a user's ear canal;

a speaker suitable for placement between said ear canal microphone and said user's outer ear, said speaker including a diaphragm which directs sound into said user's ear canal in response to a driving signal;

a controller which receives the output signal from said ear canal microphone and provides said driving signal to said speaker; and an interface unit having one or more inputs suitable for connection to respective sources of audio, said interface unit arranged to process the audio received at a user-selected input and to couple said processed audio to said speaker such that the audio received at said user-selected input is reproduced for said user;

wherein said interface unit is arranged so compress, limit, and/or equalize the audio received at said user-selected input.

31. A personal hearing control system, comprising:

an ear canal microphone suitable for placement within a user's ear canal;

a speaker suitable for placement between said ear canal microphone and said user's outer ear, said speaker including a diaphragm which directs sound into said user's ear canal in response to a driving signal;

a controller which receives the output signal from said ear canal microphone and provides said driving signal to said speaker; and an interface unit having one or more inputs suitable for connection to respective sources of audio, said interface unit arranged to process the audio received at a user-selected input and to couple said processed audio to said speaker such that the audio received at said user-selected input is reproduced for said user;

wherein said respective sources of audio can include a cell phone, telephone, MP3 player, radio, TV, computer, video game system, and/or closed-circuit theater sound system.

32. The system of claim 26, further comprising:

a sealing means which substantially seals a user's ear canal when worn, said ear canal microphone and said speaker positioned on the inner ear side of said seal.

33. The system of claim 26, wherein said system is arranged such that the output signal produced by said ear canal microphone varies with the instantaneous pressure in said ear canal.

34. A method of controlling the sound perceived by a user, comprising:

providing a means of substantially sealing a user's ear canal;

providing a speaker on the inner ear side of said sealing means having a diaphragm suitable for directing sound into said user's ear canal in response to a driving signal;

measuring the instantaneous pressure in said ear canal using an ear canal microphone suitable for placement within said user's ear canal;

providing an outer ear microphone suitable for placement on the outer ear side of said sealing means;

providing a means for receiving audio signals from one or more sources including said outer ear microphone;

providing said driving signal such that it varies with one of said received audio signals;

implementing at least one filter; and using said at least one filter to process the audio signal produced by said outer ear microphone such that a signal is coupled to said speaker which cancels sound that acoustically leaks from the outer ear side of said seal to the inner ear side of said seal.

35. The method of claim 34, further comprising:

determining the system transfer function between the audio signal produced by said outer ear microphone and the output of said ear canal microphone;

determining the system transfer function between said speaker and the output of said ear canal microphone; and implementing said at least one filter based on said system transfer functions.

36. The method of claim 35, wherein said at least one filter is at least one finite impulse response (FIR) filter, further comprising calculating the coefficients of said at least one finite impulse response (FIR) filter based on said system transfer functions.

37. The method of claim 34, wherein said filter has associated filter coefficients and is an adaptive filter, said adaptive filter arranged to automatically determine said system transfer functions and to calculate said coefficients such that a signal is coupled to said speaker which cancels sound that leaks from the outer ear side of said seal to the inner ear side of said seal.

38. The method of claim 37, wherein said filter coefficients are recalculated continuously, on a periodic basis, or when initiated by the user.

39. A universal 3D audio platform, comprising:

an ear canal microphone suitable for placement within a user's ear canal;

a speaker suitable for placement between said ear canal microphone and said user's outer ear, said speaker including a diaphragm which directs sound into said user's ear canal in response to a driving signal;

a controller which receives the output signal from said ear canal microphone and provides said driving signal to said speaker;

an interface unit arranged to process audio received at an input and to couple said processed audio to said speaker such that the audio received at said input is reproduced for said user;

a mold arranged in the concha of said user's ear such that said user's ear canal is substantially sealed;

an outer ear microphone suitable for placement on the outer ear side of said speaker and said mold, the output of said outer ear microphone coupled to an input of said interface unit, said interface unit arranged to process the output of said outer ear microphone and couple said processed output to said speaker;

said system arranged such that part of the processed signal from the outer ear microphone coupled to said speaker cancels the sound that acoustically leaks from the outer ear side of said seal to the inner ear side of said seal, thereby enabling 3D audio cues present in the remaining part of the processed signal coupled to said speaker to be adopted by said users auditory system as an internally consistent set of 3D audio cues and said system to thereby act as a standard platform for 3D audio.

40. The system of claim 39, wherein said interface unit has two or more inputs suitable for connection to respective sources of audio, said interface unit arranged to produce an output that varies with the audio received at a user-selected input and to couple said output to said speaker.

41. The system of claim 39, wherein said system is arranged such that said controller controls the relationship between the instantaneous pressure in said ear canal and said diaphragm's velocity such that said velocity is proportional to said instantaneous pressure over the range of sound frequencies that would normally be affected by the occlusion effect.

42. The system of claim 39, wherein said ear canal microphone is arranged to produce an output signal which varies with the instantaneous pressure in said ear canal.

* * * * *

UNITED STATES PATENT AND TRADEMARK OFFICE

CERTIFICATE OF CORRECTION

PATENT NO. : 8,027,481 B2
APPLICATION NO. : 11/982918
DATED : September 27, 2011
INVENTOR(S) : Terry Beard It is certified that error appears in the above-identified patent and that said Letters Patent is hereby corrected as shown below:

In the claims, Claim 5, Col. 11, line 45 reads "R1" and should read --R-- without the 1

Signed and Sealed this
Twenty-second Day of November, 2011

David J. Kappos

David J. Kappos
*Director of the United States Patent and Trademark Office*